US005117645A

United States Patent [19]

Bryant

[11] Patent Number: 5,117,645

[45] Date of Patent: Jun. 2, 1992

[54] REFRIGERATION SYSTEM WITH SATURATION SENSOR

[75] Inventor: Ralph S. Bryant, Brentwood, Tenn.

[73] Assignee: Inter-City Products Corporation (USA), LaVergne, Tenn.

[21] Appl. No.: 704,807

[22] Filed: May 23, 1991

Related U.S. Application Data

[62] Division of Ser. No. 527,530, May 23, 1990, Pat. No. 5,050,393.

[51] Int. Cl.[5] ..... F25B 41/00

[52] U.S. Cl. ..... 62/174; 62/225; 62/513

[58] Field of Search ..... 62/216, 174, 218, 504, 62/513, 115, 225

[56] References Cited

U.S. PATENT DOCUMENTS

| | | | |
|---|---|---|---|
| 1,838,165 | 12/1931 | Vollmann | 62/220 |
| 1,994,037 | 3/1935 | Gay | 62/218 |
| 2,220,998 | 11/1940 | Holmes | 62/127 |
| 2,265,282 | 12/1941 | Heinrich | 62/3 |
| 2,622,407 | 12/1952 | Bixler | 62/8 |
| 3,875,757 | 4/1975 | Amano | 62/115 |
| 4,019,337 | 4/1977 | Earfoss, Jr. | 62/225 X |
| 4,333,317 | 6/1982 | Sawyer | 62/212 |
| 4,545,212 | 10/1985 | Noda | 62/129 |
| 4,617,804 | 10/1986 | Fukushima et al. | 62/212 |
| 4,660,387 | 4/1987 | Usami | 62/184 |

*Primary Examiner*—William E. Wayner
*Attorney, Agent, or Firm*—Baker & Daniels

[57] ABSTRACT

A refrigeration system including an evaporator. A reservoir is connected to the evaporator at a point intermediate the inlet and the outlet of the evaporator. The reservoir is placed in heat exchange relationship with the suction line near the outlet of the evaporator. In one embodiment a liquid level sensor is provided in the reservoir and the output of the sensor is used to control an expansion valve connected to the inlet of the evaporator. In another embodiment a capillary or fixed orifice device is used as an expansion device for the evaporator and the reservoir acts as a refrigerant storage device to accommodate various operating conditions of the refrigeration system.

14 Claims, 2 Drawing Sheets

REFRIGERATION SYSTEM WITH SATURATION SENSOR

This is a division of application Ser. No. 07/527,530, filed May 23, 1990.

BACKGROUND OF THE INVENTION

This invention relates to an automatic control for a refrigeration system and more particularly to a control for regulating the location of the saturated vapor point in the evaporator of a refrigeration system.

Conventional refrigeration systems employ a motor driven compressor, an evaporator for absorbing heat from a load, an expansion device for controlling flow of refrigerant into the evaporator, and a condenser for discharging heat from the system. The flow control device may comprise either a fixed capillary or orifice or a controllable expansion valve which can be controlled to vary the flow of refrigerant. Thus liquid refrigerant is admitted into the evaporator so that the heat absorbed from the load will warm the liquid refrigerant and evaporate the refrigerant. If the saturation point of the refrigerant vapor is not controlled to be at or very close to the outlet of the evaporator, but is instead allowed to occur in the evaporator at some distance from the outlet, the refrigerant vapor exiting the evaporator will be superheated, i.e., the refrigerant will be heated above its vaporization temperature. The number of degrees by which the vapor is superheated above its vaporization temperature is defined as the "superheat", expressed in degrees.

For an efficient refrigeration system, it is desired that the evaporator coil be fully wetted, i.e., that the saturation point is very close to or at the outlet of the evaporator. By thus controlling the saturation point, optimum evaporator coil performance is achieved.

Refrigeration systems such as described above are conventionally used with air conditioning systems. Such air conditioning systems may be subject to variable conditions. For instance, the desired temperature of the space to be controlled may be selected to be higher or lower, the outdoor ambient temperature may vary, and thus the cooling load of the space to be controlled may vary' depending upon variations of the building loads. Thus the loading of an air conditioning system can vary greatly.

Relatively simple air conditioning systems are generally designed with a fixed restriction orifice device or capillary tube for metering liquid refrigerant into the evaporator. These systems will operate at an optimum operating point at a limited set of operating conditions. If conditions change which cause higher liquid pressure and/or lower evaporator coil loading there will be some liquid spillover at the evaporator coil exit. In that case there is too much refrigerant charge in the system for the operating condition. This reduces the system capacity and increases energy usage by the compressor. At lower heat loads or at lower liquid refrigerant pressure more superheat is produced in the evaporator because of the lack of charge, thus under-utilizing the evaporator coil surfaces.

Prior art control systems have dealt with variations in loading by providing expansion valves for controlling the metering of liquid refrigerant into the evaporator. One such valve is an electric expansion valve which required a certain amount of superheat in the refrigeration system for control of the valve. Generally the control consisted of two temperature sensing elements one of which was connected to the outlet of the evaporator and one of which was connected to some intermediate point within the evaporator coil. The difference in temperature between the two points was a measure of the superheat, and this temperature difference was used as a control variable. Some control systems have been designed which used the pressure and temperature of the evaporator outlet as a measure of superheat and have used these parameters to control the electric expansion valve.

Thermostatic expansion valves have also been widely used, which sense superheat indirectly by using the pressure of a refrigerant charged temperature sensing bulb to compare to actual pressure as a pressure equivalent of superheat.

A problem with such prior art systems has been that control of the expansion valve is by nature very sensitive to changes in temperature. Since such controls depended upon the production of some superheat in order to exercise control, it is difficult to control below a minimum superheat. As superheat setting is lowered toward zero, the control becomes more sensitive thereby causing over-control of the expansion valve and causing the system to "hunt" for a stable operating point. These control systems therefore inherently resulted in some inefficiencies of the refrigeration systems.

It is therefore desired to provide a control for a refrigeration system which eliminates hunting under steady-state conditions and which further eliminates the need for superheat so that the system will operate with the saturated vapor point of the refrigerant located at or very close to the outlet of the evaporator. Furthermore, it is desired to provide such a system which is simple and relatively inexpensive to construct. Lastly, it is desired to provide a control wherein excess refrigerant charge in the system can be stored when the heat load on the system is relatively small and which provides sufficient refrigerant charge to the system under heavy loading conditions.

SUMMARY OF THE INVENTION

The present invention overcomes the disadvantages of the above described prior art refrigeration systems by providing an improved refrigeration system therefor.

The refrigeration system of the present invention includes a control for maintaining the saturation point at or near the coil outlet, i.e. which controls within bounds of slight superheat to slight spill-over.

The system according to the present invention includes a reservoir which is in intimate heat exchange contact with the suction line of the system at or near the outlet of the evaporator. A conduit connects the reservoir in fluid flow relationship with the evaporator at a point which is located intermediate the inlet and outlet of the evaporator.

More specifically, the refrigeration system according to the present invention includes a compressor and an evaporator with a suction line connected therebetween. The evaporator has an inlet and an outlet. A reservoir is connected in intimate heat exchange contact with the suction line. A conduit is connected in fluid flow relationship between the inlet of the reservoir and the evaporator at a point intermediate the inlet and outlet of the evaporator. Therefore the pressure in the reservoir will be equal to the pressure in the evaporator at the point of connection of the conduit. The temperature of the refrigerant in the reservoir will be the same as or very close to the temperature of the suction line at the point of contact.

In one embodiment the liquid refrigerant metering device at the inlet to the evaporator is a capillary or fixed orifice with a constant restriction. In this embodiment active control of the system is directly effected by a liquid/vapor storage reservoir. In another embodiment of the invention an expansion valve is used to meter liquid refrigerant into the evaporator so that the flow rate can be varied. In that embodiment a liquid level sensor is provided in the reservoir. The sensor generates a signal dependent upon the level of the liquid refrigerant in the reservoir. This signal is routed to the expansion valve for controlling the expansion valve to thereby vary the rate at which liquid refrigerant is metered into the evaporator and thereby control the system and the location of the saturation point.

An advantage of the present invention is that it enables control of the feeding of refrigerant into the evaporator so that the evaporator coil is fully wetted with saturated refrigerant fluid yet causes minimum spillover of liquid refrigerant into the suction line.

Another advantage of the present invention is that the system is capable of controlling the evaporator with zero degrees superheat, thereby resulting in improvement of efficiency of the refrigeration system.

Still a further advantage of the present invention is that it has an integrating effect and inherently reduces hunting of the control valve and therefore is not as subject to fluctuations in the refrigerant system.

A still further advantage of the present invention is that the sensor can respond rapidly to operating changes of the system because of the fluid flow connection of the sensor to the evaporator so that the sensor instantly senses pressure changes in the evaporator rather than reacting to a change in temperature when compared to superheat measurement using two temperatures.

Yet still another advantage of the present invention is that the sensor will have better transient control characteristics during start-up and defrost switching of the refrigerant system than prior art systems.

Still a further advantage of the present invention is that the sensor is very simple in construction and provides an optimum refrigerant charge level over a range of operation of a refrigeration system with fixed expansion devices. Furthermore the sensor permits the elimination of an accumulator which in the past has been needed to maintain system performance for heating operation.

The present invention, n one form thereof, comprises a refrigeration system including a compressor, an evaporator which has an inlet and an outlet. A suction line is connected to the outlet. A control means is provided for controlling the saturation condition of refrigerant in the evaporator. The control means includes a reservoir having an inlet. The reservoir is mounted in heat exchange relationship with the suction line. A conduit connects the reservoir inlet to the evaporator at a point intermediate the evaporator inlet and outlet.

The present invention, in one form thereof, comprises a compressor and an evaporator which has an inlet and an outlet. A suction line connects the outlet of the evaporator to the compressor. Control means is provided for controlling the saturation condition of refrigerant in the evaporator. The control means includes a reservoir for storing refrigerant. The reservoir includes an inlet which is connected by a conduit to the evaporator at a point intermediate the evaporator inlet and outlet. The reservoir is mounted in heat exchange relation with the suction line at a point closely adjacent the evaporator outlet. The refrigerant collected in the reservoir is at substantially the same temperature as the refrigerant at the outlet of the evaporator.

The present invention comprises a refrigeration system including a compressor and an evaporator having an inlet and an outlet. A suction line connects the out)et to the compressor. An expansion valve is connected to the evaporator inlet for controlling the flow of refrigerant to the evaporator. A control means for controlling the valve is connected to the expansion valve. The control means includes a reservoir having an inlet. A conduit connects the reservoir inlet to the evaporator at a point intermediate the evaporator inlet and outlet. The reservoir includes a liquid level sensing means connected to the expansion valve for sensing the level of refrigerant in the reservoir and for generating a control signal for controlling the expansion valve.

The present invention, in one form thereof, comprises a method for controlling the saturation point of refrigerant in an evaporator of a refrigeration system. The evaporator has an inlet and an outlet and a suction line is connected to the evaporator outlet. An expansion device is connected to the evaporator inlet. The method comprises providing a reservoir, connecting the reservoir in fluid flow communication with the evaporator at a point intermediate the evaporator inlet and outlet. The reservoir is then connected in heat exchange relation with the suction line.

It is an object of the present invention to provide a refrigeration system which is accurately controlled to operate at or near zero degrees superheat with the saturation point of the evaporator located very close to or at the outlet the evaporator.

It is a further object of the present invention to provide a refrigeration system including a sensor and control for controlling an expansion valve and which reduces hunting of the control system.

A still further object of the present invention is to provide a control for a refrigeration system which is responsive to both the pressure within the evaporator and to the temperature at the outlet of the evaporator and which can be used with both a fixed orifice restriction device, a capillary device or with an expansion valve.

BRIEF DESCRIPTION OF THE DRAWINGS

The above mentioned and other features and objects of the invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 5:
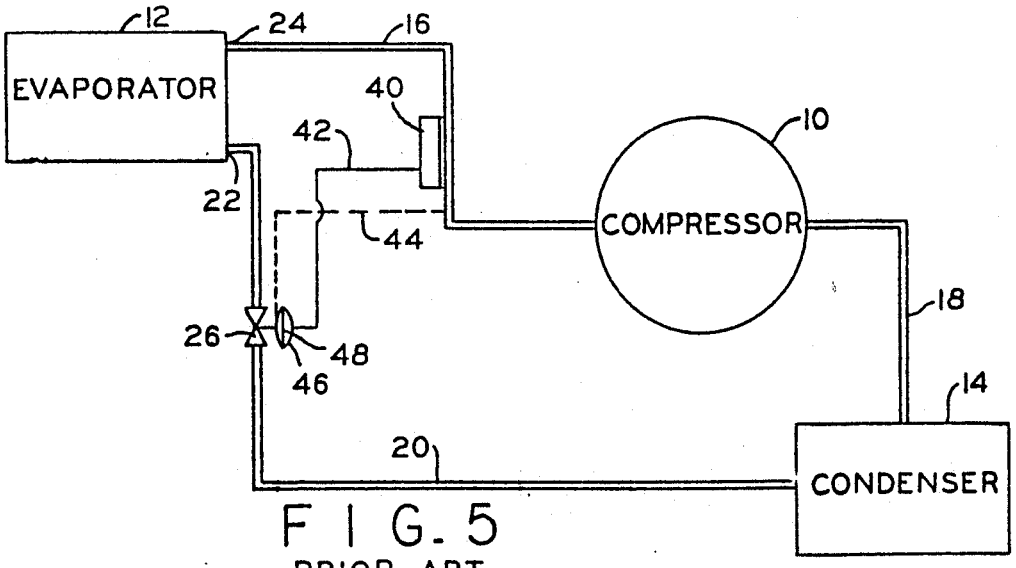
FIG. 5 PRIOR ART
FIG. 5 is a diagrammatic view of a prior art refrigeration and control system.

Referring first to FIG. 5 there is shown a prior art refrigeration system and a sensor therefor. A compressor 10 is shown and an evaporator 12. Evaporator outlet 24 is connected to the compressor by means of vapor suction line 16. Condenser 14 is shown connected to the compressor by means of a high pressure line 18. The condenser feeds refrigerant by means of a conduit 20 to an expansion valve 26 which in turn is connected to the inlet 22 of evaporator 12. A temperature sensor 40 is connected in intimate heat exchange contact with suction line 16. The sensor is connected by means of a control line 42 to one side of a control device 46 for expansion valve 26. The control device 46 includes a diaphragm 48. On the other side of the diaphragm 48 of control device 46 a connection is made to a conduit 44 which in turn is connected to suction line 16. Thus there is pressure equalization between the one side of control device 46 and suction line 16. Thus expansion device 26 will be controlled on the basis of the temperature of refrigerant vapor in suction line 16 as well as its pressure. This system will therefore attempt to maintain a constant degree of superheat of the refrigerant exiting from the evaporator, subject to the problems pointed out hereinabove.

Figure 1:
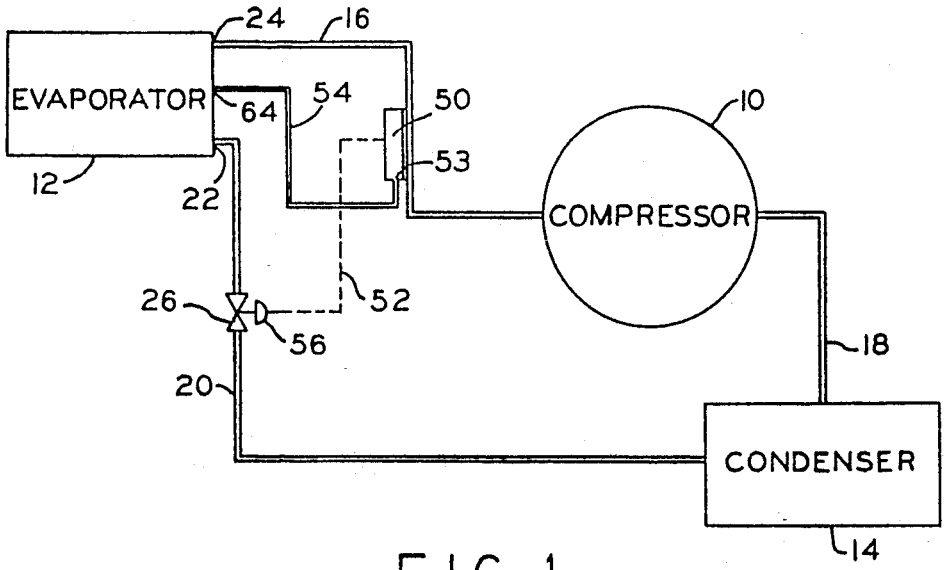
FIG. 1 is a diagrammatic view of a refrigeration system incorporating a preferred embodiment of the present invention.

Referring now to FIG. 1 there is shown an embodiment of the present invention. In this system, similarly to the prior art system shown in FIG. 5, there are shown a compressor 10, an evaporator 12, and a condenser 14. An expansion valve 26 meters liquid refrigerant into the inlet 22 of evaporator 12. Furthermore, a control 50 is shown which has an inlet 53 connected to the evaporator by means of a conduit 54. Sensor 50 is in intimate contact with suction line 16 for heat exchange therewith. Control line 52 connects sensor 50 to control device 56 for controlling expansion valve 26.

Figure 2:
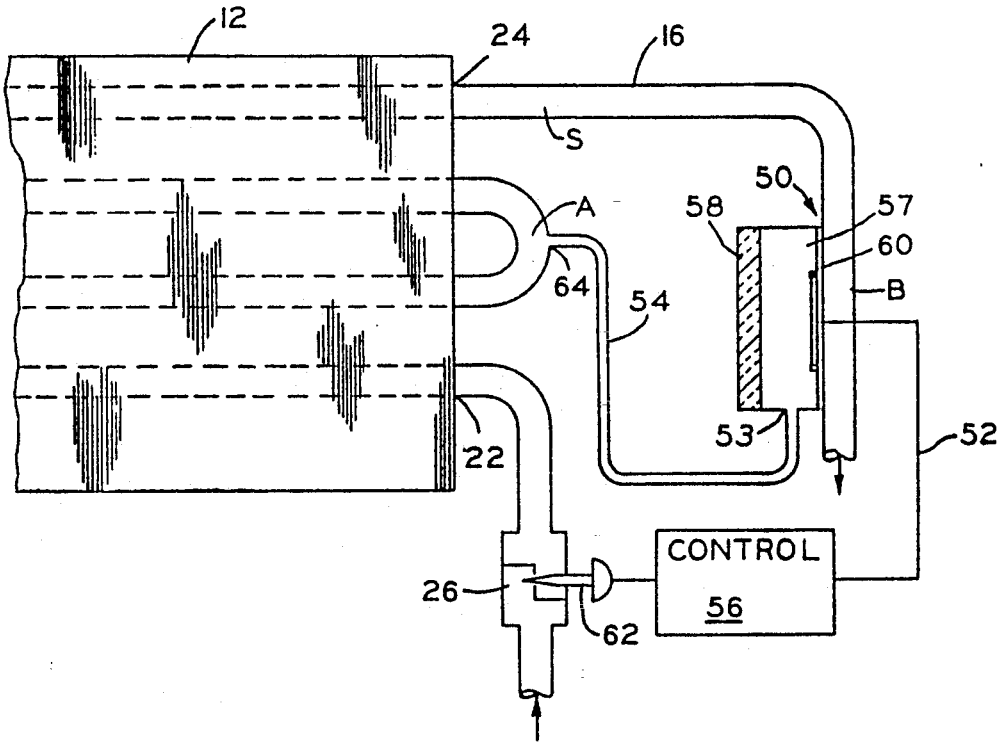
FIG. 2 is an enlarged diagrammatic view of the control for the system of FIG. 1.

Referring now to FIG. 2, the sensor 50 and control system is shown in greater detail. It can be seen that the sensor 50 comprises a reservoir 57 which is in intimate heat exchange contact with suction line 16. Insulation 58 insulates the reservoir 57 so that it will not be subject to ambient temperature conditions. The reservoir 57 includes a level sensor 60 which provides an indication of the level of liquid refrigerant within reservoir 57. A control line 52 carries signals indicative of the level of liquid refrigerant in reservoir 57 to control 56. Control 56 then provides an output signal to the expansion valve, which in turn changes the position of needle valve 62.

Level sensor 60 could comprise a single probe containing a low level indicator and a high level indicator using thermistors. Thus control could be effected between the low and high levels of liquid contained in reservoir 57. Alternatively, a number of level indication points could be provided between the high and low level indication points. Furthermore while, in the embodiment of FIG. 2, control is effected by means of system controller 56, valve 26, in a simplified control system, could be controlled directly from sensor 60.

Figure 4:
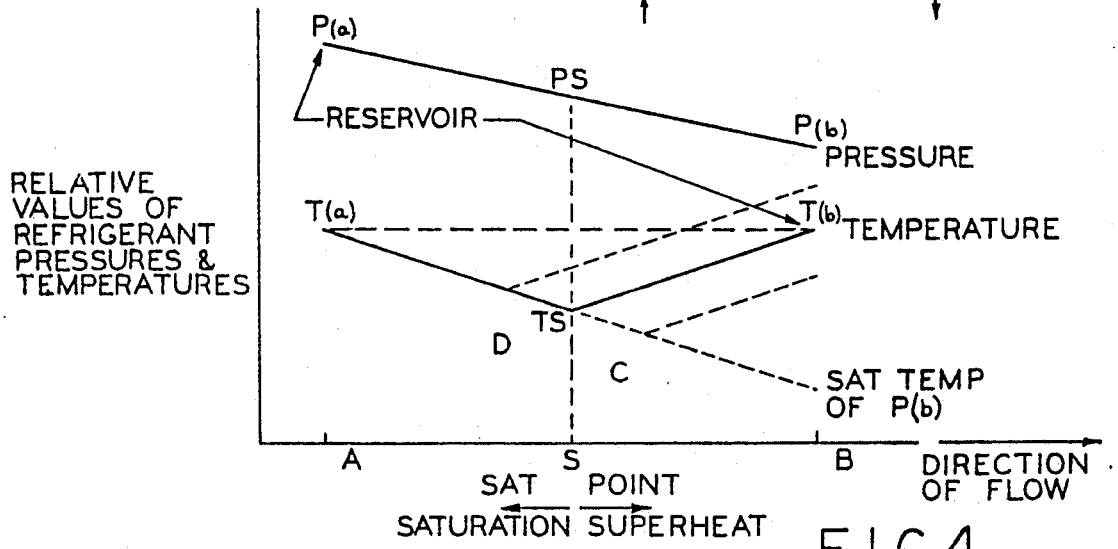
FIG. 4 is a graph showing various temperatures and pressures at various locations of the system in FIGS. 1-3.

Referring now to FIG. 4, the system of FIGS. 1 and 2 operates as follows. It is desired to position the 100% saturation point inside the vapor suction tube at or near the evaporator outlet 24. This point is indicated at "S" in FIGS. 2 and 4. As long as there is two-phase refrigerant in equilibrium in reservoir 57, the saturated vapor point lies in the evaporator or suction line 16 between point A at the capillary pressure tap 64 into evaporator 12 and point B at reservoir 57. If the location of the saturation point shifts, the refrigerant in the reservoir 57 will either boil or condense, thus changing the liquid level in reservoir 57. Reservoir 57 contains a two-phase mixture at the pressure of point A in the evaporator $P_a$ and at a temperature equal to the temperature at point B in suction line 16 ($T_b$). Thus the vapor temperature in reservoir 57 will be the temperature which is equivalent to the saturation temperature $T_a$ at pressure $P_a$. Therefore $T_b$ is equal to $T_a$ such that the two-phase equilibrium is maintained in the reservoir. If the saturation point moves forward, i.e. in the direction of the compressor, $T_b$ will decrease, thereby causing condensation of vapor in reservoir 57. The rising liquid level will signal expansion valve 26 to decrease its aperture and reduce the flow of refrigerant into the evaporator. If the saturation point moves upstream away from compressor 10, $T_b$ increases due to more superheating. Heat transfer from suction tube 16 into reservoir 57 will cause the liquid refrigerant in reservoir 57 to boil, thereby lowering its level. The lowered level will signal the expansion valve to increase its opening and permit a greater rate of refrigerant flow into the evaporator.

It should be noted that placement of capillary tap 64 relative to the location of reservoir 57 defines how tightly the saturation point is located and furthermore affects the speed of response of the system. If the reservoir 57 were perfectly insulated, then the reservoir would assume the temperature of suction tube 16. In that case the reservoir and pressure tap 64 could be brought fairly close together. This would bracket the saturation point to a well defined section of the suction line 16. Furthermore, this would be helpful for wide variations in capacity without sacrificing smooth control of the system. If the reservoir were poorly insulated, it would be affected by the ambient temperature conditions and therefore would become warmer than suction tube 16. A more upstream position of capillary tap 64 would then be selected to ensure sufficient pressure to create a two-phase equilibrium of refrigerant in reservoir 57. However this would broaden the range of saturation positions as the saturation point would be located further upstream in the evaporator.

It should also be noted that a float and sensing mechanism could be substituted for the level sensor 60 as shown in FIG. 2. The float would contact level sensing contacts on the side of reservoir 57, which contacts could comprise a low level contact and a high level contact. The sensor could also comprise various additional intermediate contacts. Operation of the system would be substantially the same to the operation as explained in connection with FIGS. 2 and 4. In a further alternative embodiment the valve and sensor could be provided in a single mechanical device using a float valve.

In the embodiment of FIG. 2 the pressure tap 64 has been shown as occurring somewhere in the evaporator. It would of course also be possible to locate the pressure tap 64 in the evaporator coil header, depending upon the ability to insulate reservoir 57.

It should also be noted that in certain applications, such as in a package heat pump application, several pressure taps would be provided depending upon which coil is used as the evaporator. Thus a three-way solenoid could be provided to switch whichever coil would be used as the evaporator to supply reservoir 57 and to use a reversing valve for pressure drop.

Figure 3:
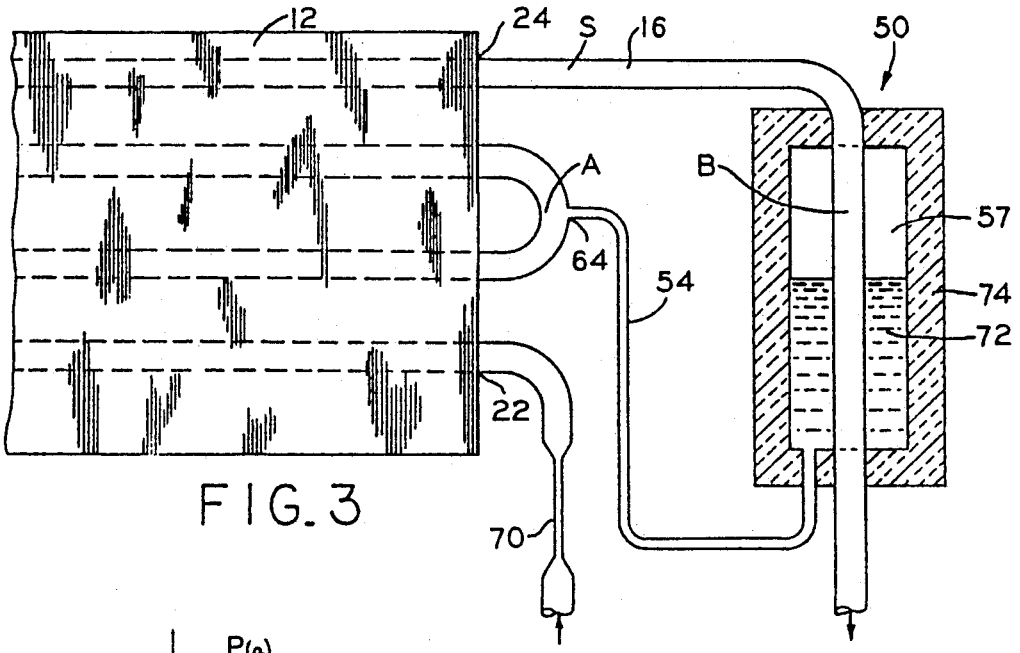
FIG. 3 is a diagrammatic view of a control system of another embodiment of the present invention.

Referring now to FIG. 3, an alternative embodiment of the invention is shown wherein a capillary or fixed orifice expansion device is used, rather than a variable expansion valve. The capillary 70 meters refrigerant into evaporator 12. Sensor 50 again includes a reservoir 57. The reservoir contains both liquid refrigerant 72 and vapor located above the level of the liquid refrigerant. It should be noted that in this embodiment suction tube 16 is routed centrally through reservoir 57. Insulation 74 insulates reservoir 57. In this embodiment the level of refrigerant in reservoir 57 varies according to conditions of the system so that the reservoir 57 acts as a storage vessel. Thus in this system active changes in the system will be directly controlled by means of reservoir 57 rather than by means of an expansion valve.

Reservoir 57 collects excess refrigerant or injects refrigerant back into the system as needed. Whenever two-phase refrigerant is in equilibrium in reservoir 57, the saturated vapor point lies between the connection point 64 of the conduit 54 into the evaporator 12 and the location of the point of contact of the suction tube with reservoir 57. The temperature and pressure relationship of the refrigerant flowing through evaporator 12 and suction tube 16 are again shown in FIG. 4. The reservoir assumes pressure $P_a$ of point 64 where the control tube 54 is connected to evaporator coil 12, and the temperature $T_b$ of the suction line. Since $T_a$ is the saturated temperature at pressure $P_a$, $T_b$ must be equal to $T_a$. In order for liquid and vapor to remain in equilibrium in the vessel, there must be a small amount of superheat gained from Point S to point B to make up for the temperature drop from point A to point S, due to the pressure drop in the evaporator. If the saturated vapor point S moves toward the reservoir to point C as shown in FIG. 4, then $T_b$ becomes lower than $T_a$, and the liquid level in reservoir 57 rises so that the saturation point S will move back upstream until equilibrium is restored. If the saturated point S moves toward point A, to point D for example as shown in FIG. 4, then $T_b$ becomes higher than $T_a$, the refrigerant charge in reservoir 57 will boil, and the saturation point S moves back downstream. Thus changes in the system are integrated as some time will elapse for the changes in the sensor to take place. This reduces hunting of the control system.

It should also be noted that, if desired the reservoir may also be placed inside the suction tube by enlarging a section of the suction tube and placing the reservoir inside. In this manner the sensor and/or reservoir would be totally insulated from the ambient temperature without requiring further insulation 58 or 74.

The invention would be particularly useful in a variable capacity refrigeration system as the system can be optimized for various operating conditions. It should also be noted that more than one sensor can be used with the refrigeration system. One of the sensors could be placed on the indoor coil and the other sensor could be placed on the outdoor coil. Both sensors could be used to drive a single valve.

It should also be noted that this control system could be used with a reversible refrigeration system such as a heat pump. When the evaporator coil is operated as a condenser, all of the liquid boils out of the sensor reservoir 57 because of the hot gas flowing through the suction tube 16. The extra charge in the system could be used to advantage. If the system is equipped with both an indoor and outdoor saturation control, the charge would exchange from one reservoir to the other when changing modes. It is also possible for a package terminal heat pump to have one saturation sensor for use in both the heating and cooling modes.

While this invention has been described as having a preferred design, it will be understood that it s capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A refrigeration system, said refrigeration system circulating refrigerant fluid through a fluid circuit, said refrigeration system comprising:

a heat exchanger coil with an inlet and an outlet;

a suction line of the fluid circuit connected to said outlet;

a refrigerant line of the fluid circuit connected to said inlet, said refrigerant line including an expansion device;

a sealed reservoir defined by a vessel body and having an inlet at the bottom of said vessel body, said vessel body disposed adjacent to and in heat exchange contact with said suction line and fluidly isolated from said suction line and said refrigerant line; and means for fluidly connecting said inlet of said vessel body with the fluid circuit at a location intermediate said expansion device and said heat exchanger coil outlet whereby the superheat level in said suction line determines the level of liquid refrigerant in said reservoir and thereby determines the location of the saturation point in said heat exchanger coil.

2. The refrigeration system of claim 1 wherein said reservoir includes insulation positioned on the external surface of said reservoir except where said reservoir is adjacent to said suction line.

3. The refrigeration system of claim 1 wherein said expansion device includes a capillary expansion device.

4. The refrigeration system of claim 1 wherein said expansion device includes an expansion valve.

5. The refrigeration system of claim 4 further comprising means for sensing the level of liquid refrigerant in said reservoir, said sensing means drivingly connected to said expansion valve whereby the sensed level of liquid refrigerant determines the amount of refrigerant fluid flowing through said expansion valve and into said heat exchanger coil.

6. A refrigeration system, said refrigeration system circulating refrigerant fluid through a fluid circuit, said refrigeration system comprising:

a heat exchanger coil with an inlet and an outlet;

a suction line of the fluid circuit connected to said outlet;

a refrigerant line of the fluid circuit connected to said inlet, said refrigerant line including an expansion device;

a reservoir disposed adjacent to and in heat exchange contact with said suction line;

means for fluidly connecting said reservoir with the fluid circuit at a location intermediate said expansion device and said heat exchanger coil outlet whereby the superheat level in said suction line determines the level of liquid refrigerant in said reservoir and thereby determines the location of the saturation point in said heat exchanger coil;

means for sensing the level of liquid refrigerant in said reservoir; and means for controlling the amount of refrigerant fluid flowing into said heat exchanger coil, said sensing means operably connected to said controlling means whereby the sensed level of liquid refrigerant determines the amount of refrigerant fluid flowing into said heat exchanger coil.

7. A refrigeration system, said refrigeration system circulating refrigerant fluid through a fluid circuit, said refrigeration system comprising:

a heat exchanger coil with an inlet and an outlet;

a suction line of the fluid circuit connected to said outlet;

a refrigerant line of the fluid circuit connected to said inlet; and means for controlling the pressure inside said heat exchanger coil, said controlling means including means for sensing the superheat temperature of said suction line and the pressure inside said heat exchanger coil, said controlling means also including means for regulating the amount of refrigerant fluid in said heat exchanger coil by collecting liquid refrigerant from and injecting liquid refrigerant into said heat exchanger coil at a point intermediate said inlet and said outlet in response to changes in the pressure inside said heat exchanger coil and the superheat temperature of said suction line whereby the superheat level in said suction line determines the level of liquid refrigerant in said controlling means and thereby determines the location of the saturation point in said heat exchanger coil.

8. The refrigeration system of claim 7 wherein said controlling means includes a reservoir fluidly connected to the fluid circuit intermediate said refrigerant line and said outlet, and said reservoir is adjacent to and in heat exchange contact with said suction line whereby the amount of refrigerant fluid in said heat exchange coil is determined by the level of superheat and the fluid pressure in said heat exchanger coil.

9. A refrigeration system, said refrigeration system circulating refrigerant fluid through a fluid circuit, said refrigeration system comprising:

a heat exchanger coil with an inlet and an outlet;

a suction line of the fluid circuit connected to said outlet;

a refrigerant line of the fluid circuit connected to said inlet;

means for controlling the pressure inside said heat exchanger coil, said controlling means including means for sensing the superheat temperature of said suction line and the pressure inside said heat exchanger coil, said controlling means also including means for regulating the amount of refrigerant fluid in said heat exchanger coil, said controlling means further including a reservoir fluidly connected to the fluid circuit intermediate said refrigerant line and said outlet, and said reservoir being adjacent to and in heat exchange contact with said suction line whereby the amount of refrigerant fluid in said heat exchange coil is determined by the level of superheat and the fluid pressure in said heat exchanger coil; and means for sensing the level of liquid refrigerant in said reservoir and means for controlling the amount of refrigerant fluid flowing into said heat exchanger coil, said liquid level sensing means operably connected to said controlling means whereby the sensed level of liquid refrigerant determines the amount of refrigerant fluid flowing into said heat exchanger coil.

10. The refrigeration system of claim 9 wherein said reservoir includes insulation positioned on the external surface of said reservoir except where said reservoir is adjacent to said suction line.

11. The refrigeration system of claim 9 wherein said refrigeration line includes means for expanding said refrigeration fluid and said fluid coupling means connects said reservoir to the fluid circuit between said expanding means and said outlet.

12. The refrigeration system of claim 11 wherein said expanding means includes a capillary expansion device.

13. The refrigeration system of claim 11 wherein said expanding means includes an expansion valve.

14. The refrigeration system of claim 13 further comprising means for sensing the level of liquid refrigerant in said reservoir, said sensing means drivingly connected to said expansion valve whereby the sensed level of liquid refrigerant determines the amount of refrigerant fluid flowing through said expansion valve and into said heat exchanger coil.

* * * * *